US007891142B1

(12) United States Patent
Ealer, Sr.

(10) Patent No.: US 7,891,142 B1
(45) Date of Patent: Feb. 22, 2011

(54) GUTTER PROTECTION SYSTEM

(76) Inventor: James E. Ealer, Sr., P.O. Box 188, St. Clair, MO (US) 63077

( * ) Notice: Subject to any disclaimer, the term of this patent is extended or adjusted under 35 U.S.C. 154(b) by 875 days.

(21) Appl. No.: 11/738,713

(22) Filed: Apr. 23, 2007

Related U.S. Application Data

(63) Continuation-in-part of application No. 10/987,930, filed on Nov. 12, 2004, now Pat. No. 7,765,742.

(51) Int. Cl.
*E04D 13/064* (2006.01)
*E04D 13/072* (2006.01)

(52) U.S. Cl. ..... 52/12; 52/11

(58) Field of Classification Search ..... 52/11, 52/12, 15

See application file for complete search history.

(56) References Cited

U.S. PATENT DOCUMENTS

| | | | | |
|---|---|---|---|---|
| 891,406 | A | | 6/1908 | Cassens |
| 1,597,503 | A | * | 8/1926 | Andrews ..... 52/12 |
| 1,676,517 | A | | 7/1928 | Birkholz |
| 2,022,255 | A | | 11/1935 | Scott |
| 2,175,521 | A | * | 10/1939 | Fry ..... 52/12 |
| 2,209,741 | A | * | 7/1940 | Sullivan et al. ..... 210/474 |
| 2,271,081 | A | | 1/1942 | Layton |
| 2,988,226 | A | | 6/1961 | Campbell |
| 3,067,881 | A | | 12/1962 | Goosmann |
| 3,108,406 | A | | 10/1963 | Ellis |
| 3,351,206 | A | | 11/1967 | Wennerstrom |
| 3,388,555 | A | | 6/1968 | Foster |
| 3,774,274 | A | | 11/1973 | Jury |
| 3,950,951 | A | | 4/1976 | Zukauskas |
| 4,307,976 | A | | 12/1981 | Butler |
| 4,404,775 | A | | 9/1983 | Demartini |
| 4,418,504 | A | | 12/1983 | Lassiter |
| 4,631,875 | A | | 12/1986 | Olson |
| 4,695,033 | A | | 9/1987 | Imaeda |
| 4,727,689 | A | | 3/1988 | Bosler |
| 4,750,300 | A | | 6/1988 | Winger, Jr. |
| 4,769,957 | A | | 9/1988 | Knowles |
| 4,796,390 | A | | 1/1989 | Demartini |
| 4,841,686 | A | | 6/1989 | Rees |
| 4,905,427 | A | | 3/1990 | McPhalen |
| 4,907,381 | A | * | 3/1990 | Ealer ..... 52/12 |
| 4,936,061 | A | | 6/1990 | Palma |
| 4,937,986 | A | | 7/1990 | Way, Sr. et al. |
| 4,941,299 | A | | 7/1990 | Sweers |

(Continued)

FOREIGN PATENT DOCUMENTS

| | | |
|---|---|---|
| DE | 3905961 | 9/1989 |

(Continued)

OTHER PUBLICATIONS

Office action regarding U.S. Appl. No. 11/566,446; 38 pages.

(Continued)

*Primary Examiner*—Phi Dieu Tran A
(74) *Attorney, Agent, or Firm*—Senniger Powers LLP

(57) ABSTRACT

A gutter protection system includes a rear margin formed to avoid contact with a fastener securing a gutter to the structure and to better inhibit collapse of the protection system.

11 Claims, 17 Drawing Sheets

U.S. PATENT DOCUMENTS

| | | | | | |
|---|---|---|---|---|---|
| D310,259 | S | | 8/1990 | Hitchins | |
| 5,010,696 | A | | 4/1991 | Knittel | |
| 5,072,551 | A | | 12/1991 | Manoogian, Jr. | |
| 5,081,814 | A | | 1/1992 | Singletary et al. | |
| 5,092,086 | A | | 3/1992 | Rognsvoog, Sr. | |
| 5,095,666 | A | | 3/1992 | Williams, Jr. | |
| 5,103,601 | A | | 4/1992 | Hunt | |
| 5,109,640 | A | | 5/1992 | Creson | |
| 5,251,410 | A | | 10/1993 | Carey | |
| 5,271,191 | A | | 12/1993 | Vahamaki | |
| 5,271,192 | A | * | 12/1993 | Nothum et al. | 52/12 |
| 5,388,377 | A | * | 2/1995 | Faulkner | 52/11 |
| 5,406,754 | A | | 4/1995 | Cosby | |
| 5,438,803 | A | | 8/1995 | Blizard, Jr. | |
| 5,522,183 | A | | 6/1996 | Allen | |
| 5,611,175 | A | | 3/1997 | Sweers | |
| 5,619,825 | A | * | 4/1997 | Leroney et al. | 52/12 |
| 5,632,128 | A | | 5/1997 | Agar | |
| 5,709,051 | A | | 1/1998 | Mazziotti | |
| 5,813,173 | A | | 9/1998 | Way, Sr. | |
| 5,842,311 | A | | 12/1998 | Morin | |
| 5,893,240 | A | * | 4/1999 | Ealer, Sr. | 52/12 |
| 6,151,836 | A | | 11/2000 | McGlothlin | |
| 6,151,837 | A | | 11/2000 | Ealer, Sr. | |
| 6,161,338 | A | | 12/2000 | Kuhns | |
| 6,269,592 | B1 | | 8/2001 | Rutter | |
| 6,516,577 | B2 | | 2/2003 | Pelfrey | |
| 6,568,132 | B1 | | 5/2003 | Walters | |
| 6,598,352 | B2 | * | 7/2003 | Higginbotham | 52/12 |
| 6,708,453 | B1 | | 3/2004 | Hurst et al. | |
| 6,883,760 | B2 | | 4/2005 | Seise, Jr. | |
| 6,904,718 | B2 | | 6/2005 | Fox | |
| 6,941,707 | B2 | | 9/2005 | Sigmund | |
| 6,951,077 | B1 | | 10/2005 | Higginbotham | |
| D523,538 | S | | 6/2006 | Brochu | |
| 7,104,012 | B1 | | 9/2006 | Bayram | |
| 7,143,549 | B2 | * | 12/2006 | Brochu | 52/12 |
| 7,191,564 | B2 | | 3/2007 | Higginbotham | |
| 7,310,912 | B2 | | 12/2007 | Lenney | |
| 7,627,991 | B1 | * | 12/2009 | Feldhaus | 52/12 |
| 7,707,781 | B2 | * | 5/2010 | Van Cleave et al. | 52/11 |
| 7,793,465 | B2 | * | 9/2010 | McCann | 52/12 |
| 2003/0009951 | A1 | * | 1/2003 | Bergeron | 52/12 |
| 2004/0000098 | A1 | * | 1/2004 | Knudson | 52/12 |
| 2004/0182014 | A1 | * | 9/2004 | Brochu | 52/12 |
| 2005/0115190 | A1 | * | 6/2005 | Brown | 52/720.1 |
| 2005/0204642 | A1 | * | 9/2005 | Valentini | 52/12 |
| 2006/0053697 | A1 | * | 3/2006 | Higginbotham | 52/12 |
| 2006/0101722 | A1 | | 5/2006 | Ealer, Sr. | |
| 2006/0201068 | A1 | | 9/2006 | Shane | |
| 2006/0230687 | A1 | * | 10/2006 | Ealer, Sr. | 52/12 |
| 2008/0010906 | A1 | * | 1/2008 | Brochu | 52/12 |
| 2008/0047206 | A1 | * | 2/2008 | Gramling | 52/12 |
| 2008/0098661 | A1 | * | 5/2008 | McCann | 52/12 |
| 2008/0134587 | A1 | * | 6/2008 | Ealer | 52/12 |
| 2008/0190040 | A1 | * | 8/2008 | Graves | 52/12 |
| 2008/0289263 | A1 | * | 11/2008 | Brochu | 52/12 |
| 2009/0235592 | A1 | * | 9/2009 | Knudson et al. | 52/12 |
| 2009/0320381 | A1 | * | 12/2009 | Gerig | 52/12 |
| 2010/0071273 | A1 | * | 3/2010 | Joly et al. | 52/12 |

FOREIGN PATENT DOCUMENTS

| | | | |
|---|---|---|---|
| DE | 3829384 | | 3/1990 |
| JP | 11264160 | A | 9/1999 |

OTHER PUBLICATIONS

Office action regarding U.S. Appl. No. 11/567,919; 17 pages.
Office Action dated Oct. 24, 2007, U.S. Appl. No. 11/105,653, 24 pages.
Gutter World, Inc., Price List, Aug. 1, 1985, 4 pages.
Gutter World, Inc., The Ultimate Guards brochure, 1985, 2 pages.
McNichols, Flattened Expanded Metal web page, http://www.mcnichols.com/products/expanded/flat, 3 pages.
McNichols, Standard Expanded Metal Details web page, http://www.mcnichols.com/products/expanded/standard/em_stdrd2.htm, 5 pages.
McNichols, Tolerance Specifications for Expanded Metal web page, http://www.mcnichols.com/products/expanded/tables/em_tol.htm, 2 pages.
TWP, Inc., Galvanized Hardware Cloth web page, http://www.twpinc.com/galvanized.html, 3 pages.
Office Action dated Jun. 14, 2010 regarding U.S. Appl. No. 11/567,919, 11 pages.
Office Action dated Jun. 24, 2010 regarding U.S. Appl. No. 12/419,404, 8 pages.

* cited by examiner

GUTTER PROTECTION SYSTEM

CROSS-REFERENCE TO RELATED APPLICATION

This application is a continuation-in-part and claims priority from U.S. patent application Ser. No. 10/987,930 filed Nov. 12, 2004, which is incorporated herein by reference.

BACKGROUND OF THE INVENTION

The present invention relates generally to rain gutters and more particularly to a gutter protection system or cover for preventing debris from falling into such gutters.

Background information regarding existing gutter covers and screens may be found in the parent application, and in U.S. Pat. Nos. 5,893,240 and 6,151,837, all of which are incorporated by reference herein for all purposes. Since leaves and other debris frequently clog up rain gutters, some kind of cover which prevents debris from falling into the gutter is desirable. Ideally, a gutter cover directs water into the gutter, prevents debris from entering the gutter, does not itself become clogged with debris, does not collapse into the gutter under loads (such as snow or debris loads), and is securely attached to the gutter. The ideal gutter protection requires no maintenance after installation.

A new Florida roofing code requires that shingles be attached to one another ("stuck down" shingles), and these shingles consequently do not allow a gutter cover or screen to be slipped under the shingle, as is done with conventional shingles. A new cover or protection system is needed that can be easily and cost-effectively installed in gutters adjacent to these "stuck down" shingles.

SUMMARY OF THE INVENTION

In general, an aspect of this invention is directed to a gutter protection system for covering a gutter and for preventing debris from falling into the gutter. In one aspect, the gutter includes a gutter hanger having a front portion engaging a front of the gutter, a center portion extending over a channel of the gutter, and a rear portion bent upward from the center portion and engaging a rear of the gutter. The gutter also includes a fastener through the rear portion of the hanger for securing the hanger and gutter. The gutter protection system comprises an elongate member extending over the gutter channel and engaging the gutter hanger. The elongate member includes as viewed in cross-section, a rear margin having a first forwardly-opening bend, a second forwardly-opening bend spaced downward from the first bend, a third rearwardly-opening bend spaced downward from the second bend, and a bottom section extending downwardly from the third bend and terminating in an end engaging the hanger. The rear margin is thereby formed to avoid contact with the fastener and to inhibit collapse of the protection system.

In another aspect of the invention, the elongate member of a gutter protection system includes, as viewed in cross-section, a rear margin having a first uppermost bend, a second inward bend spaced downward from the first bend, a third outward bend spaced downward from the second bend, a fourth outward bend spaced from the third bend, and a bottom section extending downwardly at an angle from the fourth bend. A recess is thereby formed by the bends in the rear margin, the recess receiving the fastener so that the protection system does not contact the fastener.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
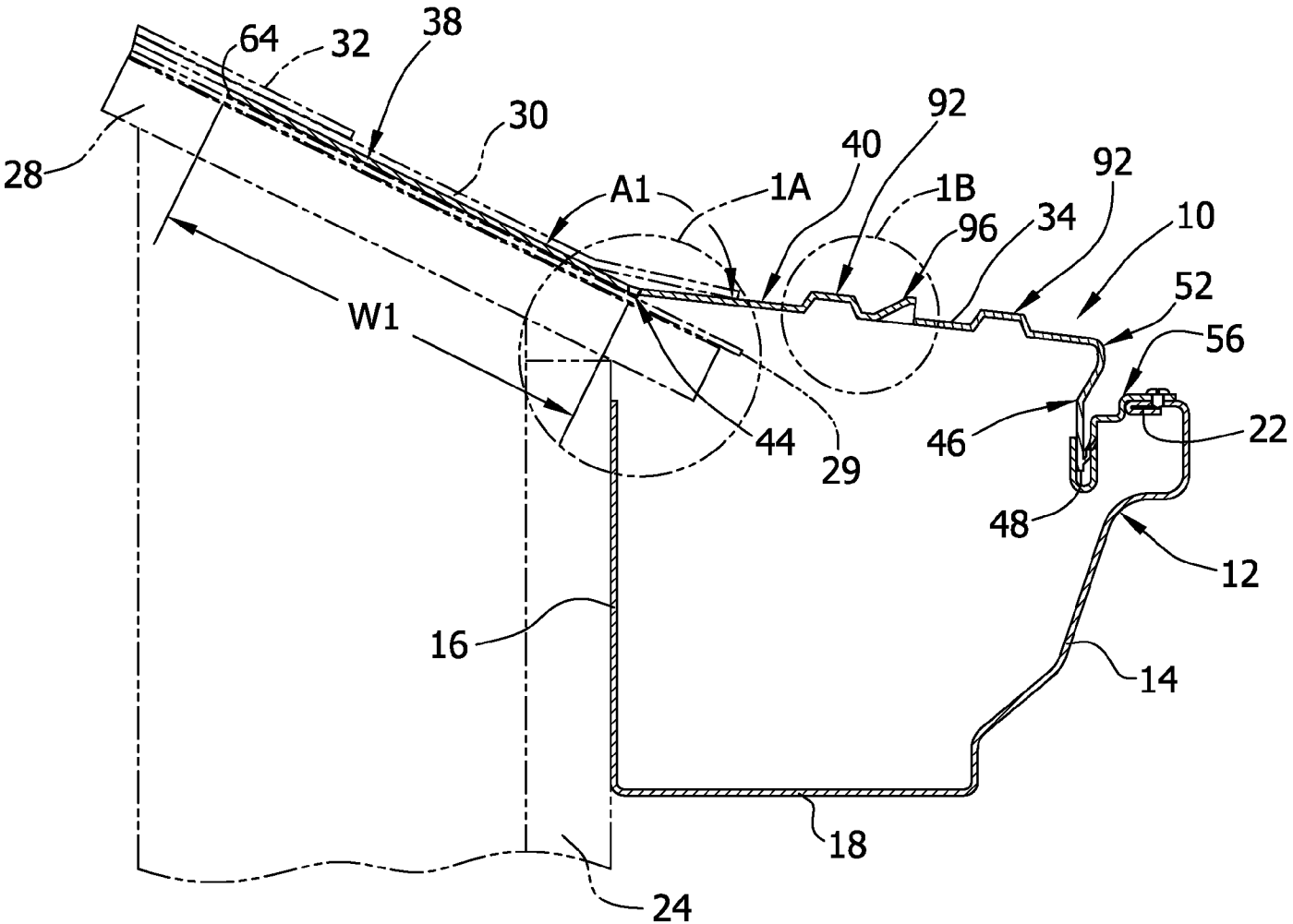
FIG. 1 is a transverse cross-sectional view of a gutter cover of the present invention installed on a gutter.
Figure 2:
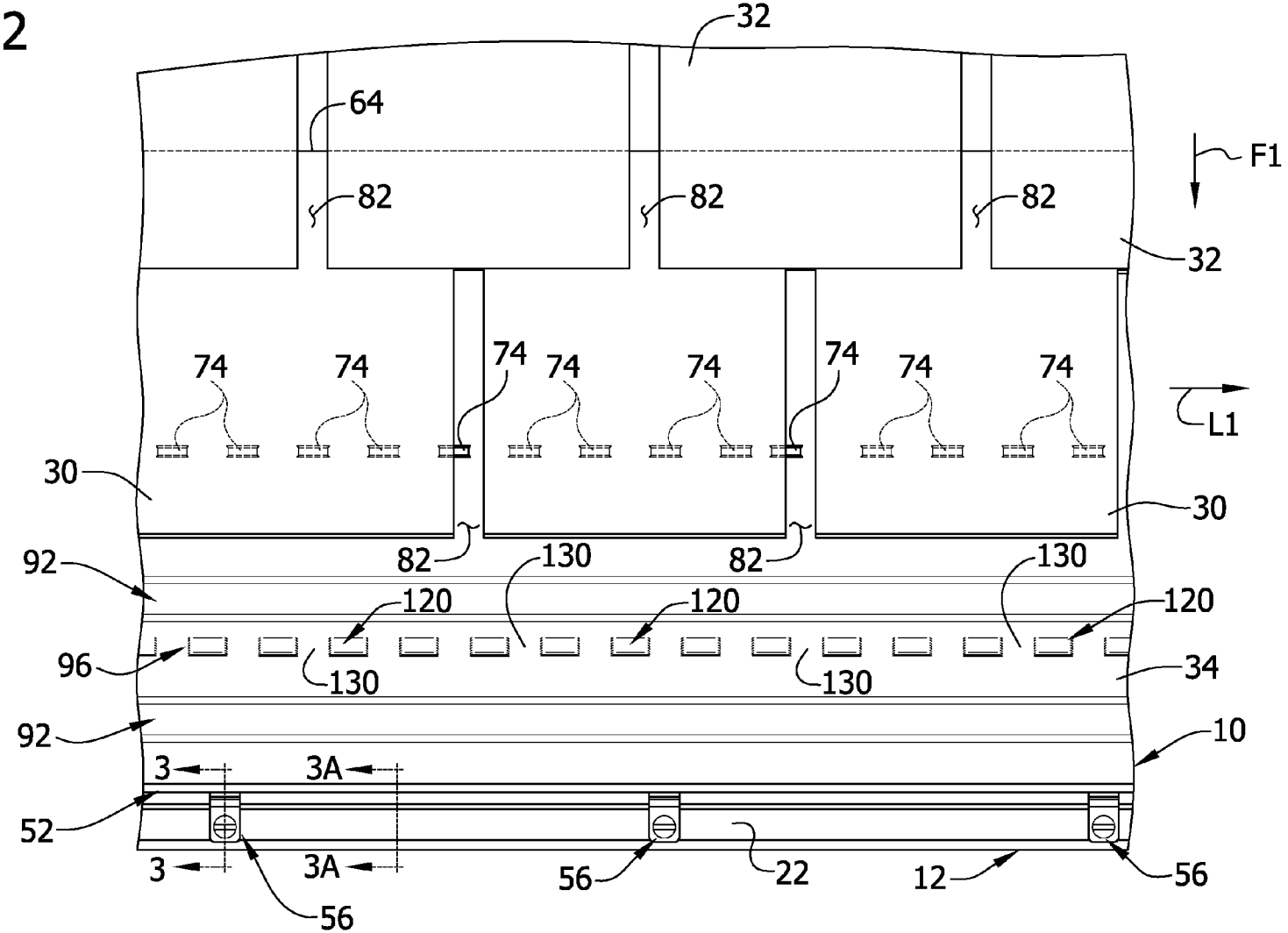
FIG. 2 is a fragmentary top plan view of the gutter cover of FIG. 1.

Now referring to the drawings, a gutter cover of a first embodiment is generally designated 10. The gutter cover is particularly adapted for covering a conventional rain gutter 12 and preventing debris from falling into the gutter. As shown in FIG. 1, the gutter 12 has a front wall 14, a back wall 16 and a bottom wall 18, which combine to form a channel for drainage of rainwater. A conventional flange 22 projects rearwardly (i.e., toward the building) from the upper edge of the front wall 14. The gutter 12 is suitably attached to a wall 24 of the building by gutter hangers (not shown) to collect rainwater flowing off a downwardly sloping roof 28 of the building. As shown in FIG. 2, a starter row of shingles 29 are attached to the roof 28 to overhang the lower edge margin of the roof, a first (lower) row of shingles 30 are attached to the roof 28 above the starter row of shingles, and a second row of shingles 32 are attached to the roof generally above the lower row. As is discussed in detail below, the gutter cover 10 of this embodiment is held in place between the shingles 30, 32 and is attached to the flange 22 of the gutter 12. The gutter cover 10 receives water from the roof 28 and directs the water across the top surface of the cover and into the gutter 12.

The gutter cover 10 comprises an elongate sheet 34 having a longitudinal axis L1 (FIG. 2) transverse to the direction F1 of water flow down the roof. The sheet 34 includes an upper, shingle mounting portion 38 for reception between the first row shingles 30 and the starter row shingles 29 next to the roof 28, a covering portion 40 adjacent the shingle mounting portion sized to extend over the gutter 12, a bend line 44 separating the mounting portion and the covering portion, and a downwardly extending flange 46 adjacent the covering portion forming a lowermost edge 48 of the cover. The sheet 34 has a surface tension curve 52 for directing water from the covering portion 40 onto the downwardly extending flange 46 and into the gutter 12. In the illustrated embodiment, the cover 10 is attached to the gutter 12 by clips, generally indicated 56, affixed to the cover flange 46 and the gutter flange 22. In one embodiment, the sheet 34 is made of sheet metal (e.g., aluminum) but it is understood that the sheet may include or be made of other materials (e.g., plastic, vinyl, etc.)

As shown in FIGS. 1 and 2, the shingle mounting portion 38 is substantially flat, continuous, unbroken and uninterrupted. The shingle mounting portion 38 is inserted between the first row of shingles 30 and the starter row shingles 29 so that the cover 10 is held in place, at least in part, by the weight of the shingles attached to the roof and the friction force between the shingles and the cover. The shingle mounting portion 38 has a top surface 60 in contact with the shingles 30, a bottom surface 62 in contact with the roof 28, and an upper edge 64 that wedges between the shingles 30 and the roof 28 when installing the cover 10 on the roof. The shingle mounting portion 38 is sized to have a lateral width W1 so that a portion of the top surface of the cover 10 is in contact with the shingles 30 and at least a portion of the bottom surface of the cover is in contact with the starting row shingles 29 next to the roof 28. In one embodiment, the shingle mounting portion 38 may have a width of about 1 inch to 7 inches, in one embodiment about 5 inches.

The bend line 44 is located upstream of the lower edge of the first row of shingles 30 and extends parallel to the longitudinal axis L1 of the cover and comprises a bend 70 in the sheet 34 that separates the shingle mounting portion 38 from the covering portion 40. In the illustrated embodiment, the bend 70 is configured such that bend angle A1 between the covering portion 40 and the shingle mounting portion 38 is about 135 degrees, but it is understood that the angle A1 could vary depending on the slope of the roof 28.

Figure 1A:
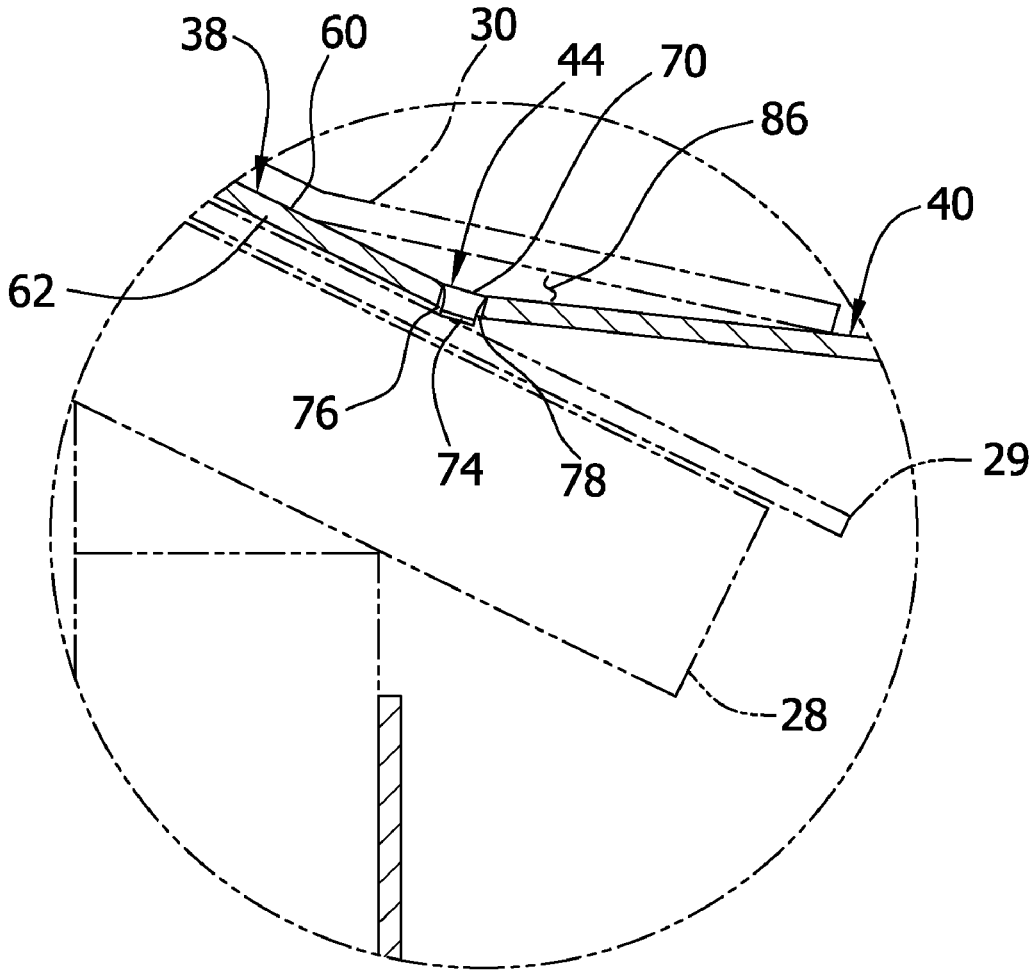
FIG. 1A is an enlarged portion of FIG. 1.

As shown in FIGS. 1A and 2, the bend line 44 comprises a portion of the sheet 34 that has a series of downwardly struck sections 74 equally spaced across the longitudinal length of the cover 10. As shown in FIG. 1A, the downwardly struck sections 74 have openings 76, 78 on both sides to weaken the sheet 34 along the bend line 44 so that the sheet may be easily manipulated when installing the cover 10. The sheet 34 may be manipulated along the bend line 44 so that a correct bend angle A1 may be easily set at the jobsite in accordance with the pitch of the roof 28, and without requiring additional work or machinery at the jobsite to weaken the sheet during installation.

As shown in FIG. 2, the shingles 38, 40 typically have a shingle gap 82 between the adjacent shingles on each row. The bend line 44 is located below the first row of shingles 38 such that the bend angle A1 creates a change in direction of the flow path of water flowing down the shingle gap 82 on the cover. As shown in FIG. 1A, the space between the cover 10 at the bend angle A1 and the first row of shingles 38 creates a pocket 86 that collects water flowing down the shingle gap 82. The pocket 86 causes the flow of water down the shingle gap 82 to collect at the bend angle A1 between the shingle mounting portion 38 and the covering portion 40 of the sheet 34. As water fills the pocket 86, the water is distributed more evenly across the longitudinal length of the cover 10 prior to flowing onto the covering portion 40 of the cover.

Figure 1B:
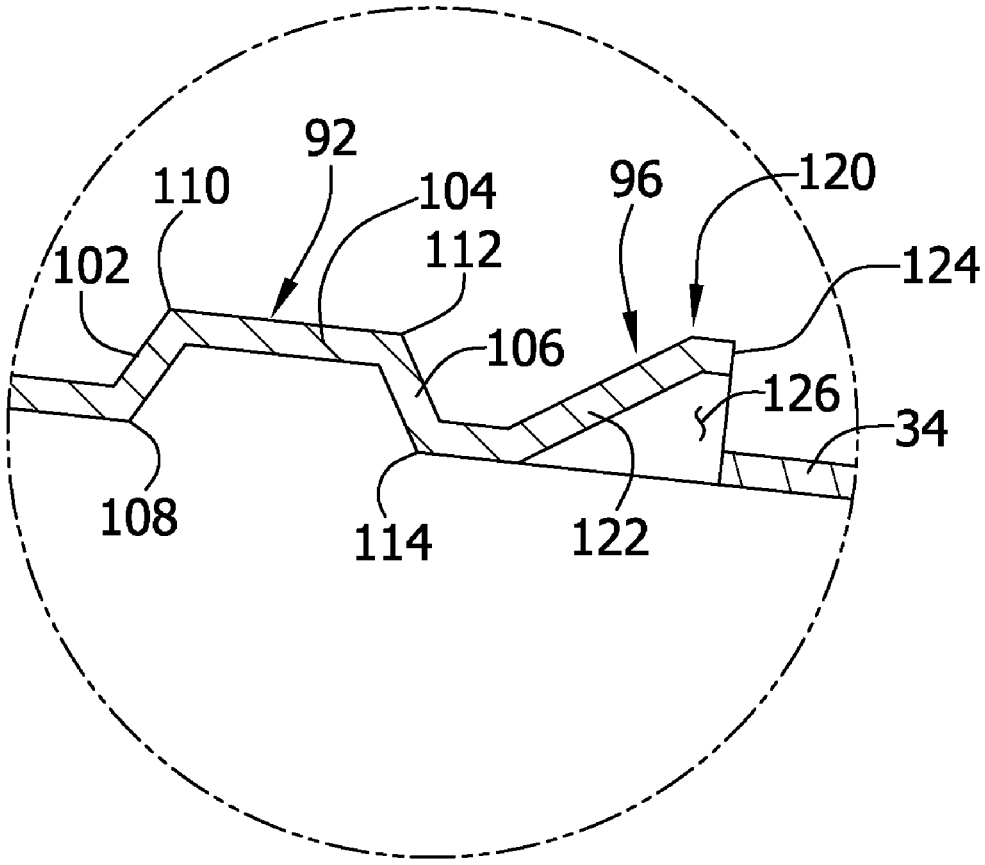
FIG. 1B is an enlarged portion of FIG. 1.

In the illustrated embodiment, the covering portion 40 has two spaced apart ribs, generally indicated 92, extending the length of the sheet 34 and a debris separator 96 located between the ribs. As shown in FIG. 1B, each rib 92 includes an upper ramp portion 102, a top wall 104 generally parallel to the covering portion of the sheet 34, and a lower ramp portion 106. The ribs 92 each have a first bend 108 connecting the upper ramp 102 with the covering portion 40 of the sheet 34, a second bend 110 connecting the upper ramp with the top wall 104 of the rib, a third bend 112 connecting the top wall with the lower ramp 106, and a fourth bend 114 connecting the lower ramp with the covering portion of the sheet.

The ribs 92 stiffen the covering portion 40 of the sheet 34 to inhibit flexing or bending of the covering portion. The ribs 92 thereby allow the sheet 34 to be made of a thinner sheet of material. The sheet 34 may be made of material having a thickness no greater than 0.10 inch. In one embodiment, the sheet 34 is made from aluminum having a thickness of about 0.032 inch, but it is understood that other materials and thickness may be used. For example, the sheet 34 may be made of vinyl or plastic and have a thickness of about 0.050 inch.

The ribs 92 distribute the water flow across the longitudinal length of the cover 10 so that the water does not flow in discrete flow paths or streams spaced along the length of the cover. The even distribution of water across the longitudinal length of the cover 10 increases the surface tension holding the water to the cover and prevents the water from flowing over the flange 22 of the gutter 12. The first bend 108 of each ramp 92 creates a change in direction that allows water flowing down the covering portion 40 of the cover 10 to momentarily collect against the upper ramp portion 102 of each rib prior to the water flowing over the top wall 104 of the rib. The water that collects against the upper ramp portion 102 is distributed across the longitudinal length of the cover 10 prior to flowing across the top wall 104 of the ramp 92 and down the lower ramp portion 106. The water distributed across the longitudinal length of the cover 10 has an increased surface tension, as compared to discrete streams, that hold the water to the top surface of the cover.

The debris separator 96 separates debris (e.g., leaves) from the water flowing over the cover 10. As shown in FIG. 1B, the debris separator 96 includes a series of upwardly struck portions, generally indicated 120, of the sheet 34 that each have a ramp 122 and a free end 124 spaced apart from the sheet. In the illustrated embodiment, each of the free ends of the upwardly struck portions form an opening 126 in the sheet 34, (so that portions form "perforated louvers") but it will be understood that the debris separator 96 may be formed without openings in the sheet without departing from the scope of this invention. Also, the debris separator 96 could comprise downwardly struck sections of the sheet 34 or have ramps 122 that are otherwise shaped (e.g., curved) without departing from the scope of this invention. In the illustrated embodiment the upwardly struck portions 120 are aligned in a row parallel to the longitudinal length of the sheet, but could be otherwise arranged.

As shown in FIG. 2, the debris separator 96 includes unbroken portions 130 of the sheet 34 located between each of the spaced apart upwardly struck portions 120. As water and debris contact the ramp 122 of the upwardly struck portions 120 of the sheet 34, the water tends to flow around the ramp across the unbroken portion of the sheet between the upwardly struck portions of the debris separator 96 with some of the water flowing over the ramp and through the openings. As the water and debris pass over the upwardly struck portions 120, the surface tension holding the debris is broken by air pockets formed between the upwardly struck portions. In some embodiments, the ramp 122 of the debris separator 96 may have a height ranging from about 1/16 inch to 1/4 inch, in one embodiment about 1/8 inch, and a width ranging from about 1/8 inch to 1 inch, in one embodiment about 3/8 inch. The broken surface tension between the debris and the water flowing over the cover 10 created by the debris separator 96 causes the debris to separate from the water.

Figure 3:
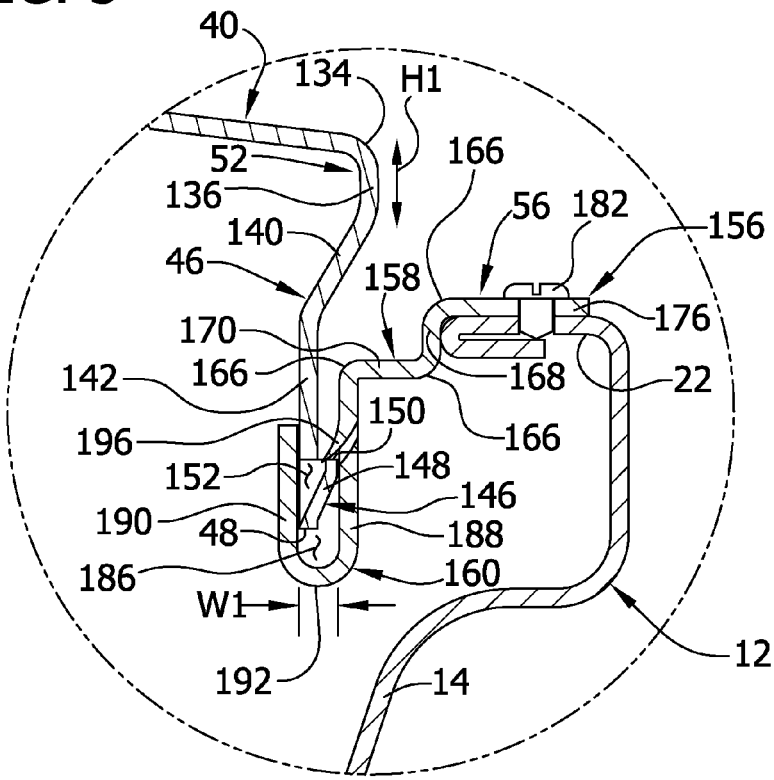
FIG. 3 is an enlarged portion of FIG. 1.

The surface tension curve 52 of the cover 10 directs the water flowing down the covering portion 40 of the cover onto the flange 46 and into the gutter 12. As shown in FIG. 3, the surface tension curve 52 has a varying slope with a first upper curve 134 adjacent the covering portion 40 of the sheet 34 and a second lower curve 136 adjacent the first curve. In the illustrated embodiment, the upper curve 134 has a smaller radius of curvature than the lower curve 136. The lower curve 136 has a larger radius of curvature requiring less surface tension for the water to adhere to the sheet 34 as the water flows over the surface tension curve 52. As such, the water flowing down the sheet 34 adheres to the sheet when flowing over the surface tension curve 52 and does not overflow the gutter 12. Any debris that reaches the surface tension curve 52 will not be adhered to the water so that it will not enter the gutter 12. The momentum of the debris will tend to carry it over the edge of the gutter 12.

In some embodiment, the upper curve 134 may have a radius of curvature ranging from about 1/8 inch to 1/2 inch, in one embodiment about 3/8 inch, and the lower curve 136 may have a radius of curvature ranging from about 1/4 inch to 1 inch, in one embodiment about 5/8 inch. It is understood that instead of two distinct curves 134, 136, the surface tension curve 52 may comprise a continuous curved surface having a varying (e.g., increasing) radius of curvature.

In some embodiments, the surface tension curve 52 may have a height H ranging from about inch to 1 3/4 inch, in this embodiment about 1 inch. The reduced height of the curve 52 allows the gutter cover 10 to have a lower profile and a more appealing look as compared to prior art covers.

The downwardly extending flange 46 extends from the surface tension curve 52 and forms the lowermost edge 48 of the gutter cover 12. As shown in FIG. 3, the flange 46 has an angled upper portion 140 connected to the lower curve 136 of the surface tension curve 52 and a substantially vertical lower portion 142. In the illustrated embodiment, the lower portion 142 of the flange has holding ribs generally indicated 146 (only one of which is shown in FIG. 3) in the form of longitudinally spaced apart outwardly struck portions 148 that have a free, upper end 150 forming an opening 152 for receiving a portion of the clip 56. The holding ribs 146 of the flange 46 are engageable with the holding clips 56 that secure the cover 10 to the gutter 12. The holding ribs 146 may comprise a bent section without openings for engagement with the clips 56, or any other arrangement to secure the cover 10 to the clips, without departing from the scope of this invention.

Figure 3A:
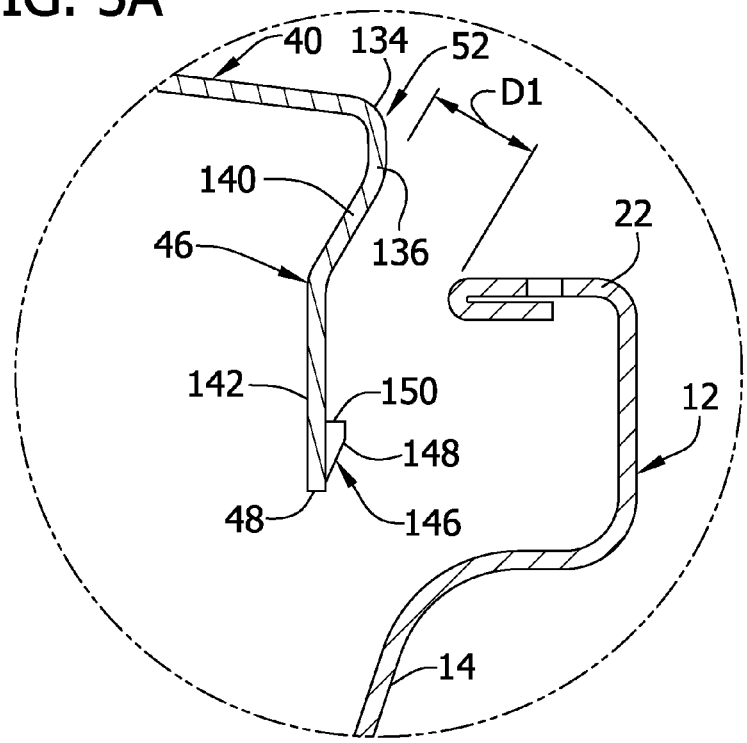
FIG. 3A is an enlarged cross-section taken along the plane including line 3A-3A of FIG. 2.
Figure 4A:
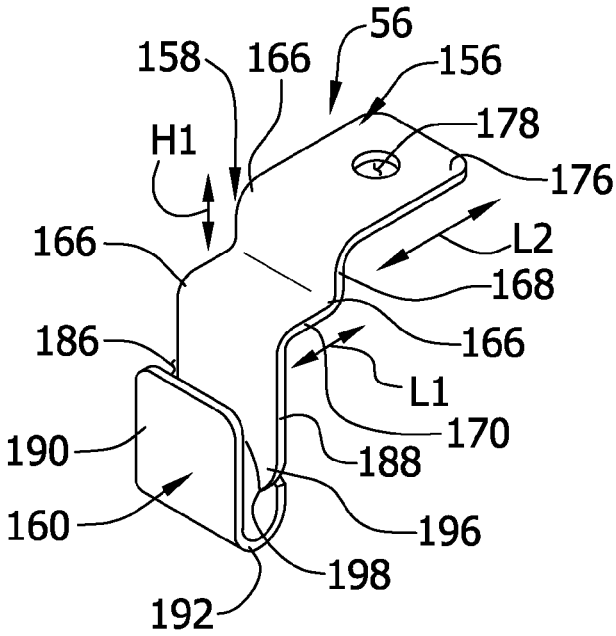
FIG. 4A is a detail perspective of a clip.
Figure 4B:
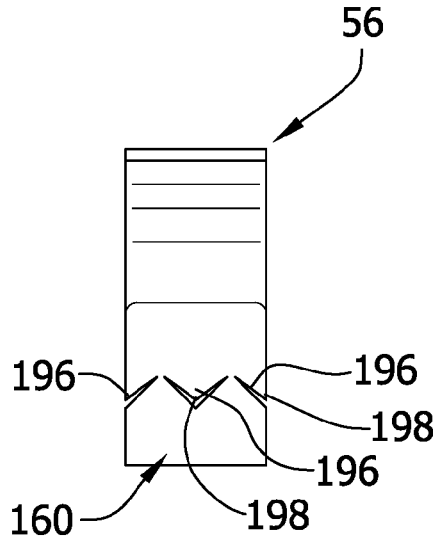
FIG. 4B is a rear elevation of the clip of FIG. 4A.

Each clip 56 attaches the cover 10 to the gutter 12 and is connected to the downwardly extending flange 46 of the cover on one end and the flange 22 of the gutter 12 on the other end. As shown in FIGS. 3, 3A, and 4A, the clips 56 have a fastening portion, generally indicated 156, for fastening the clip to the gutter 12, a spacer, generally indicated 158, for spacing the cover 10 from the gutter flange 22 by a distance D1 (FIG. 3A), and a receiver, generally indicated 160, for receiving the lower edge 48 of the cover. The distance D1 between the cover 10 and the gutter flange 22 is small enough to prevent debris from falling into the gutter 12 and large enough to allow the water into the gutter so that water does not fall outside the gutter.

The spacer 158 includes three ninety degree bends 166, a vertical section 168, and a horizontal section 170. As seen in FIG. 3, the vertical section 168 of the spacer 158 contacts the flange 22 of the gutter 12 when the clip 56 is installed on the gutter. The vertical section 168 has a height H1 (FIG. 4A) that may range from about 1/16 inch to 1/4 inch (in one embodiment about 1/8 inch), and the horizontal section has a length L1 (FIG. 4A) ranging from about 1/16 inch to 1/4 inch (in one embodiment about 1/8 inch). The spacer 158 is suitably sized so that the distance D1 ranges from about 1/32 inch to 1/2 inch, in one embodiment about 1/8 inch. As shown in FIGS. 3 and 4A, the fastener portion 156 includes a substantially flat tab 176 generally parallel to the top surface of the gutter flange 22. The tab 176 extends from the top bend 166 of the spacer 158 and has an opening 178 for receiving a screw 182 or other fastener (e.g., rivet) that attaches the clip 56 to the flange 22 of the gutter 12. The fastener portion 156 has a length L2 (FIG. 4A) suitably ranging from about 1/4 inch to 3/4 inch, in one embodiment about 3/8 inch. The opening 178 may have a diameter ranging from about 1/16 inch to 1/4" (more preferably about 1/8") to accommodate various size fasteners 182 for connecting the clip 56 to the gutter flange 22.

The receiver portion 160 of the clip 56 has a generally U-shaped cross-section forming an opening 186 that receives the downwardly extending flange 46 and the lower edge 48 of the cover 10. The receiver 160 has an inner wall 188 and outer wall 190 that are spaced apart and connected by a 180 degree bend 192 at the bottom of the clip 56. The outer wall 190 extends down from the lower bend 192 of the spacer 158 and includes a row of barbs 196 that are struck outwardly from the plane of the wall. The barbs 196 are shaped to engage the holding ribs 146 on the downwardly extending flange 46 of the cover 10. In the embodiment of FIGS. 1-4B, each barb 196 has a pointed free end 198 that engages the holding ribs 146 on the flange 46 of the cover 10. It is understood that the holding ribs 146 may be omitted so that the barbs 196 engage the flat surface of the flange 46 to secure the clips 56 to the cover 10, without departing from the scope of this invention.

Figure 5A:
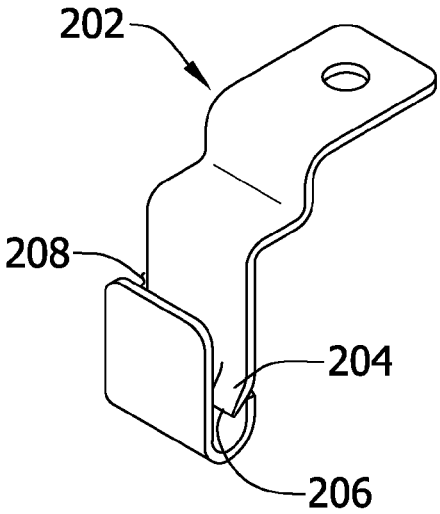
FIG. 5A is a detail perspective of a second embodiment of the clip.
Figure 5B:
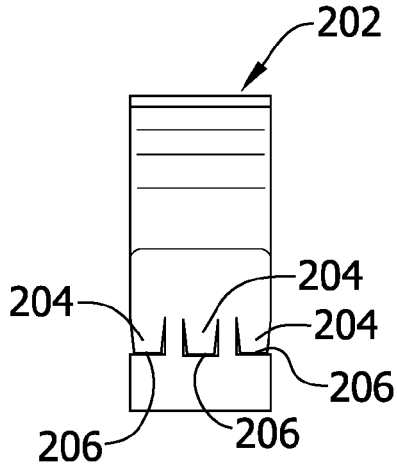
FIG. 5B is a rear elevation of the clip of FIG. 5A.

Each barb 196 has a length ranging from about 1/16 inch to about 1/4 inch (more preferably about 1/8 inch). More or less than three barbs 196 may be provided on each clip 56 and the barbs may be arranged in multiple rows on the receiver 160. It is understood that the barbs 196 may have other shapes and sizes than described herein without departing from the scope of this invention. For example, FIGS. 5A and 5B show an alternative embodiment of the clips 202 having a row of barbs 204 with flat free ends 206.

The inner wall 188 of the receiver 160 has a free end spaced away from the outer wall 190 to form the opening 208 for receiving the downwardly extending flange 46 of the cover 10. The opening 208 suitably has a width W1 (FIG. 3) ranging from about 1/16 inch to 1/4 inch (in one embodiment about 1/8 inch) so that the flange 46 engages the barb 196 on one side and the innermost wall 188 of the receiver 160 on the other side.

Figure 6:
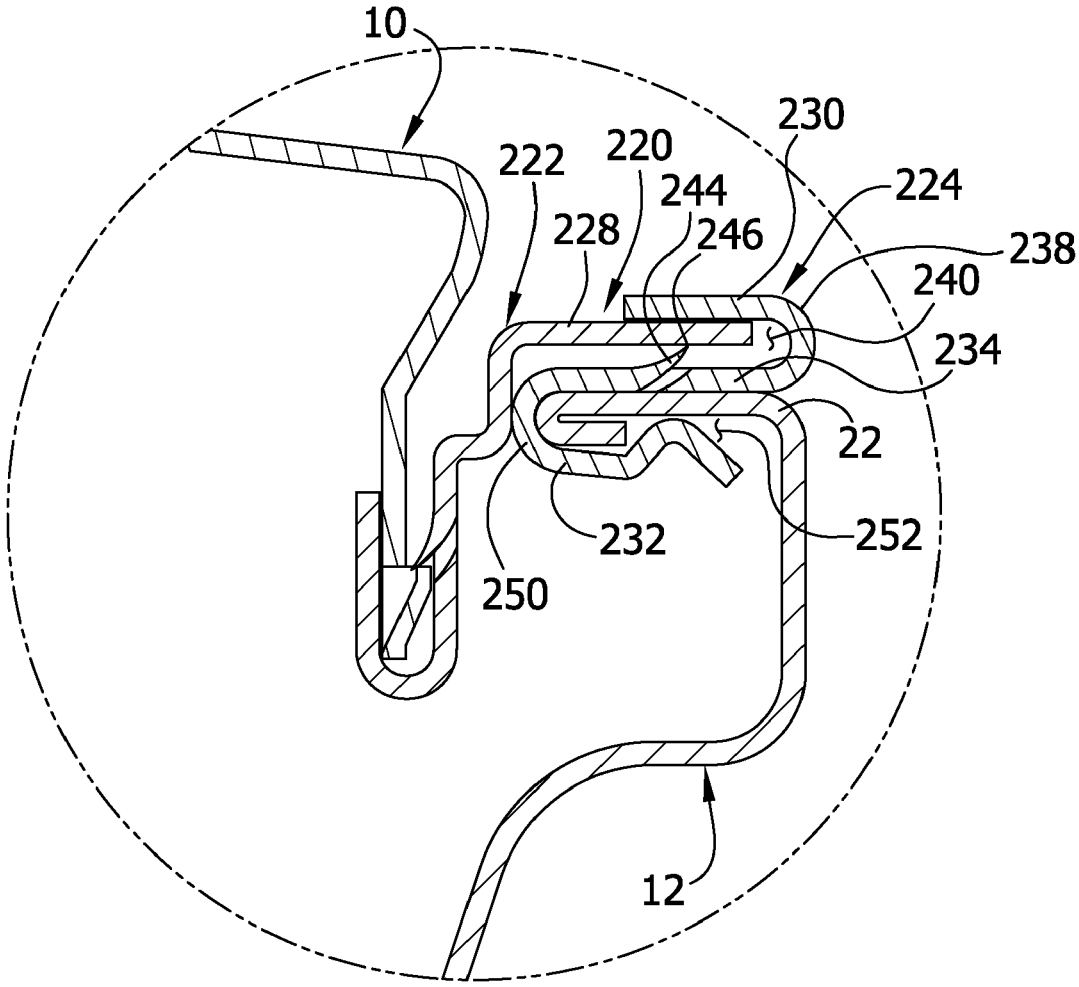
FIG. 6 is an enlarged cross-section similar to FIG. 3 but showing a third embodiment of the clip.

FIG. 6 shows an alternate embodiment of the invention in which the cover 10 is attached to the gutter by a clip assembly, generally designated 220, including a first clip, generally indicated 222, similar to the clip 56 illustrated in FIGS. 1-4 and a second clip, generally indicated 224, attached to a fastener portion 228 of the first clip. As shown in FIG. 6, the second clip 224 as a generally inverted S-shaped cross-section with an upper wall 230, a lower wall 232, and an intermediate wall 234. An upper 180 degree bend 238 connects the upper wall 230 and intermediate wall 234 and forms a gap 240 therebetween for receiving the fastener portion 228 of the first clip 222. In the illustrated embodiment, the second clip 224 has a barb 244 upwardly struck from the intermediate wall 234 such that the barb has a free end 246 that extends into the gap 240. The barb 244 engages the bottom surface of the fastener portion 228 of the first clip 222 so that the first and second clips 224 are held in secure engagement.

The second clip 224 has a second 180 degree bend 250 that connects the intermediate wall 234 and the lower wall 232 and forms a gap 252 therebetween for receiving the gutter flange 22. In one embodiment, the second clip 224 is made of a flexible material (e.g., aluminum or steel) having a thickness ranging from about 0.01 inch to about 0.10 inch, in one embodiment about 0.024 inch, so that the bottom wall 232 acts as a spring finger that may flex away from the intermediate wall 234 to widen the gap 252 for attachment of the clip to the flange 22 of the gutter 12. The bottom wall 232 of the second clip 224 is biased against the gutter flange 22 so that a holding force against the gutter flange secures the second clip and gutter cover 10 to the gutter 12.

Figure 7:
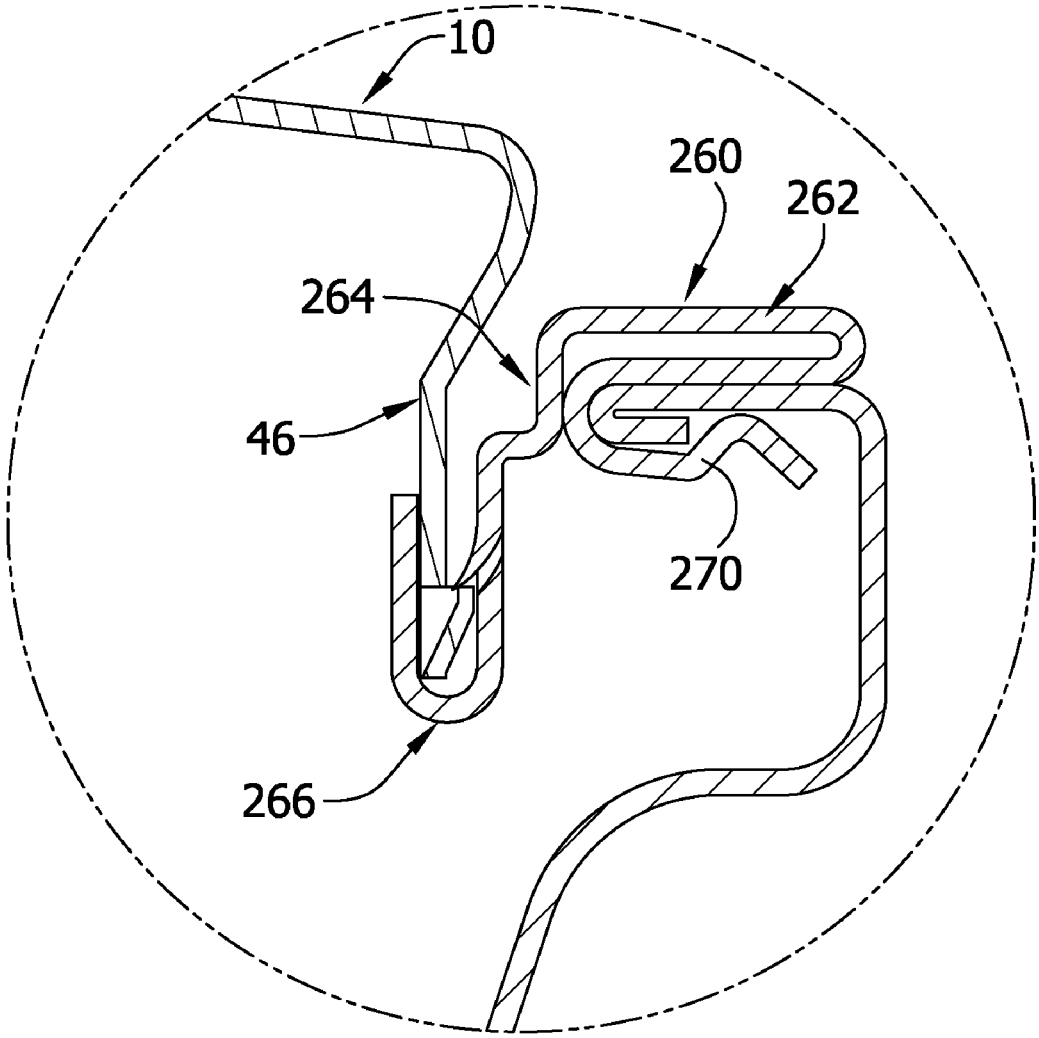
FIG. 7 is a view similar to FIG. 6 but showing a fourth embodiment of the clip.

FIG. 7 shows an alternative embodiment of a one-piece holding clip, generally indicated 260, similar to the two-piece clip assembly of FIG. 6, but formed of a single piece of material. As with the previous embodiments, the clip 260 has a fastening portion 262 for attaching the clip to the gutter 12, a spacer 264 for spacing the cover away from the gutter by the proper distance D1, and a receiver portion 266 having a generally U-shaped cross-section for receiving the downwardly extending flange 46 of the cover 10. The fastener portion 262 of the clip 260 is similar to the two-piece design of FIG. 6 in that the clip has a spring biasing member 270 that presses against the gutter 12 to secure the clip to the gutter. The fastening portion 262, receiver 266, and spacer 264 of the clip are formed integrally as a single piece of bent sheet metal.

Figure 8:
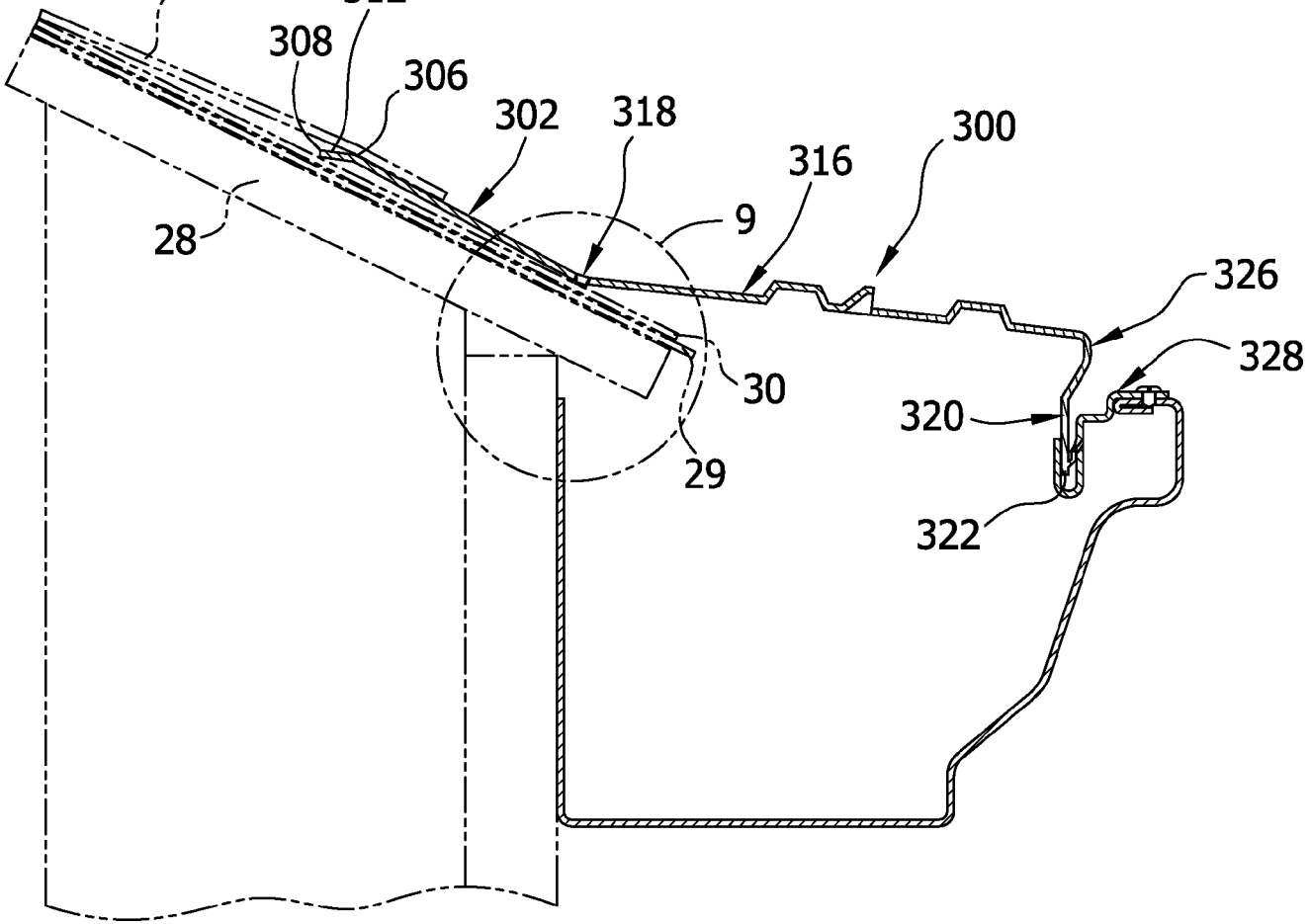
FIG. 8 is a transverse cross-sectional view of a second embodiment of the gutter cover installed on the gutter.
Figure 9:
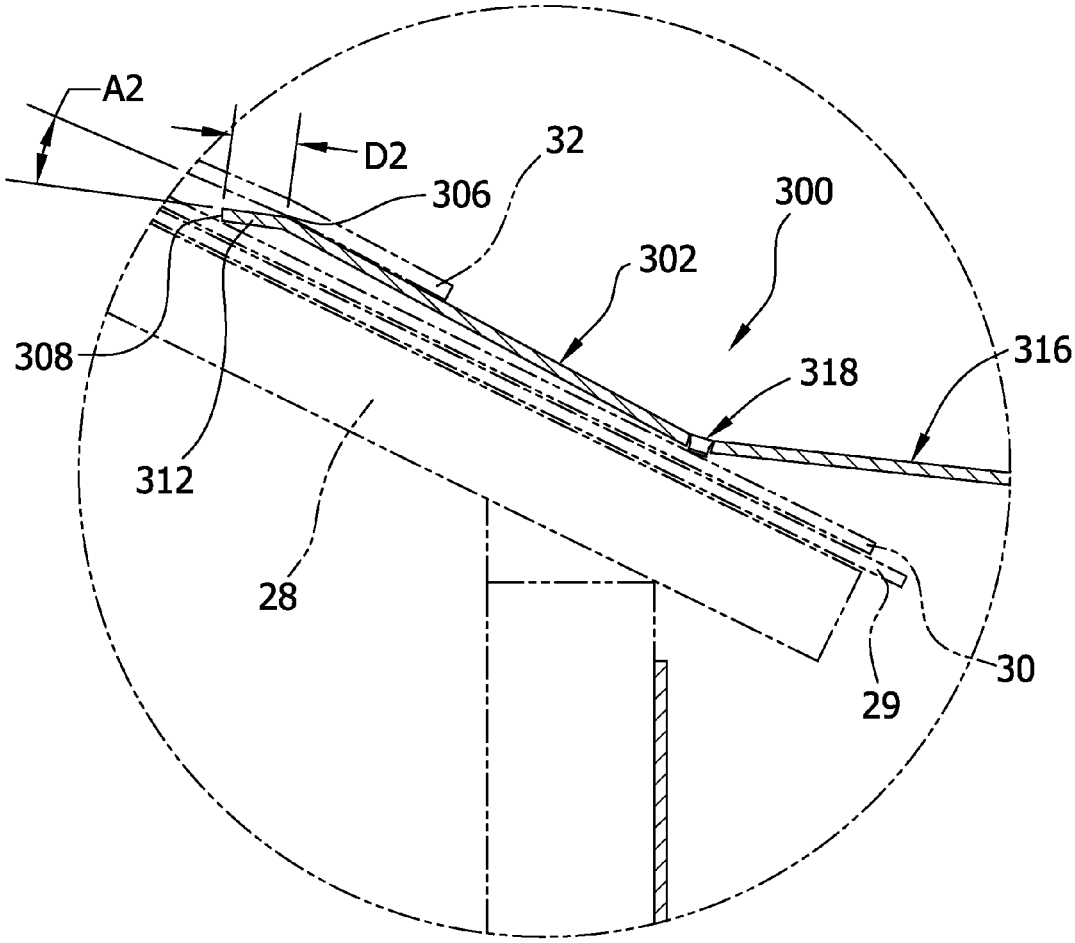
FIG. 9 is an enlarged portion of FIG. 8.

FIGS. 8 and 9 show a second embodiment of the gutter cover, generally designated 300, that is held in place below the second row of shingles 32 on the roof 28. The gutter cover 300 of this embodiment is similar to the previous embodiment except the shingle mounting portion 302 is extended so that the cover may be mounted beneath the second row of shingles 32 on the roof 28.

The shingle mounting portion 302 includes a continuous sheet that has an upper bend 306 located generally adjacent to an upper free end 308 of the cover 300. As shown in FIG. 9, a downwardly bent portion 312 of the cover 300 contacts the top surface of the first row of shingles 30 to prevent water in the shingle gap 82 of the second row of shingles 32 from flowing under the cover. In one embodiment, the upper bend 306 is spaced away from the free end 308 of the cover 300 by a distance ranging from about ¼ inch to 2 inches, in one embodiment about 1¼ inch. The bent portion 312 of the cover 300 may form an angle A2 relative to the top surface of the cover ranging from about 15 degrees to 75 degrees, in one embodiment about 30 degrees. This downwardly bent portion 312 may also be used with the embodiment of FIG. 1.

As in the previous embodiments, the cover 300 has a covering portion 316 adjacent the shingle mounting portion 302 sized to extend over the gutter 12, a bend line 318 separating the mounting portion and the covering portion, and a downwardly extending flange 320 adjacent the covering portion forming a lower edge 322 of the cover. The cover 300 has a surface tension curve 326 downstream from the covering portion 316 connecting the covering portion with the flange 320 for directing water from the covering portion onto the downwardly extending flange and into the gutter 12. Some or all of these features may be omitted within the scope of the invention.

In the illustrated embodiment, the cover 300 is attached to the gutter by clips 328 affixed to the downwardly extending flange 320 of the cover and the gutter flange 12. It is understood that the cover 300 of this embodiment may be attached to the gutter 12 by other clips as described herein (e.g., two-piece clip assembly or one-piece clip without fasteners) or other means without departing from the scope of this invention.

Figure 10:
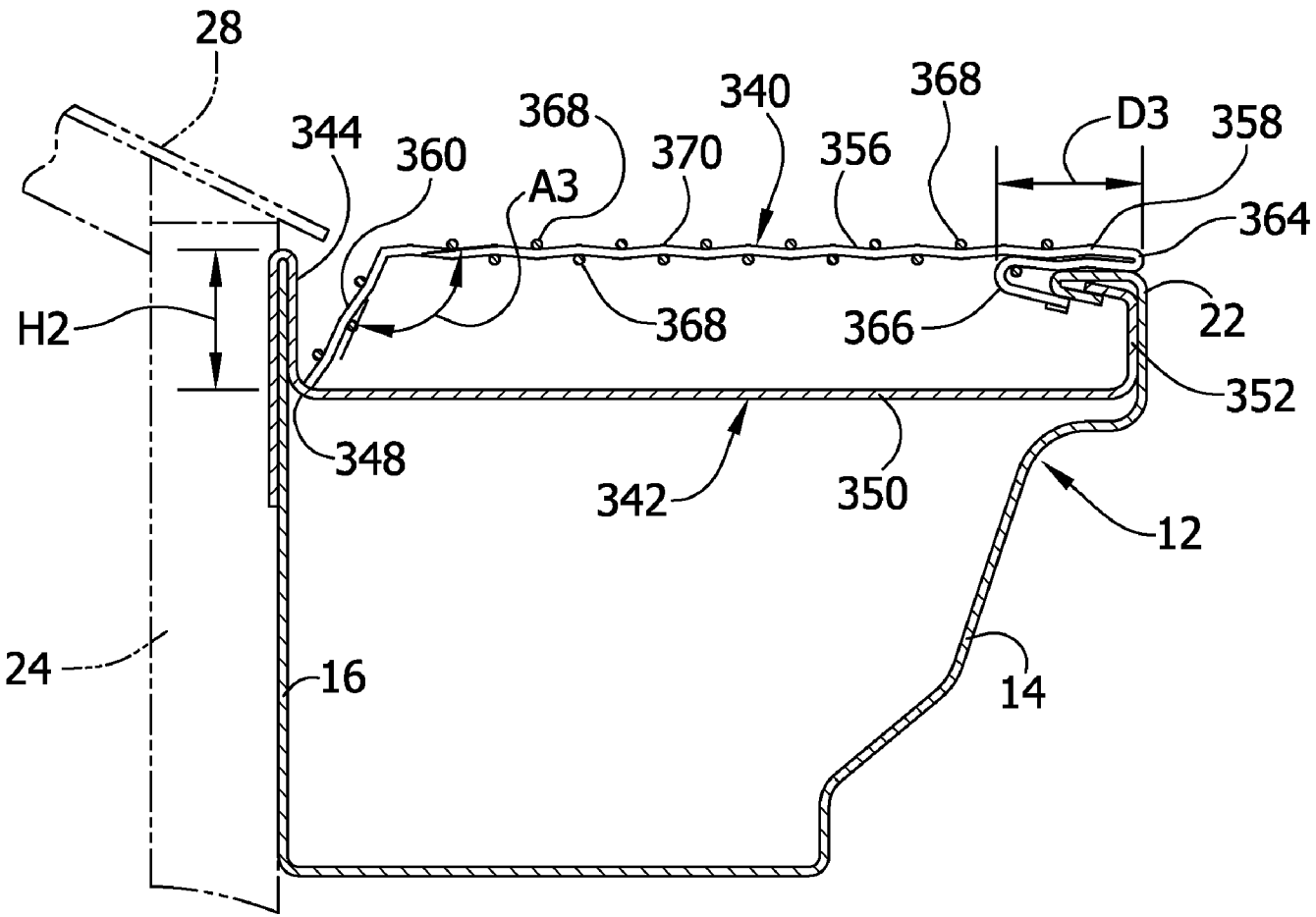
FIG. 10 is a transverse cross-sectional view of a third embodiment of the gutter cover installed on the gutter.

FIG. 10 shows an alternative embodiment of a gutter cover, generally indicated 340, that is sized to fit generally between the opposed walls 14, 16 of the gutter 12. The gutter 12 is attached to the outside wall 24 of a building by gutter hangers, one of which is shown and designated 342. The hanger has a back portion 344 bent to hook over the back wall 16 of the gutter 12 and adapted to receive a fastening device, such as a screw or nail (not shown), to secure the gutter to a wall 24 adjacent the roof 28. The hanger 342 has a 90 degree bend 348 that connects the back portion 344 with a central portion 350 of the hanger that extends over the channel formed by the opposed walls 14, 16 of the gutter 12 to support the front wall and reinforce it against inwardly directed pressures, such as are frequently caused by ladders leaning against the gutter. A front portion 352 of the hanger 340 is bent to fit inside the gutter flange 22 to reinforce the front wall 14 against outwardly directed forces, such as caused by someone pulling on the gutter while climbing onto roof.

As shown in FIG. 10, the cover 340 has a generally flat central portion 356, a front edge margin 358 formed integrally with the central portion and bent downwardly to contact the front wall 14 of the gutter 12, and a rear edge margin 360 formed integrally with the central portion and bent downwardly to contact the rear portion 344 of the gutter hanger 342. The front edge margin 358 has an upper bend 364 and a lower bend 366 so that the front edge margin of the cover 340 is bent relative to the central portion 350 to form a channel having a generally V-shaped cross section for receiving the gutter flange 22 therein. The rear edge margin 360 engages the bend 348 in the hanger 342 so that the gutter cover 340 is held in place by the contact of the rear edge margin with the hanger and the front edge margin 358 with the gutter flange 22.

In the embodiment of FIG. 10, the gutter cover 340 comprises a flexible resilient metal, such as an aluminum or steel alloy, and is of integral construction, that is, it is formed from a single continuous section of screening. The gutter cover 340 includes strands of spaced apart wire 368 running perpendicular to edge margins of the cover and strands of spaced apart wire 370 running parallel to the edge margins, the parallel and perpendicular strands being interwoven with one another to form a unitary wire mesh screen having openings therein. The wire mesh screen allows water to enter the gutter 12 through the openings between the strands 368, 370 but prevents debris from passing through the cover 340. A gutter cover made from similar material is disclosed in U.S. Pat. No. 4,907,381, incorporated by reference herein for all purposes. It is understood that the gutter cover 340 may comprise other materials (e.g., a continuous sheet of metal, vinyl, or plastic having machined holes, or wire mesh having smaller or larger openings) that allow water to flow into the gutter 12 and prevent the entry of debris into the gutter or any other material that is resilient so that it can be bent into the configuration shown and held there in tension.

In one embodiment, the gutter cover 340 has a height H2 ranging from about inch to 1½ inch, in one embodiment about 1⅛ inch. The V-shaped cross section of the front channel may have a depth D3 ranging from about inch to 1½ inch, in one embodiment about ¾ inch. The bend 366 of the front edge margin forming the lower channel of the cover 340 may have a radius ranging from about 1/16 inch to ⅝ inch, in one embodiment about ⅛ inch. In one embodiment the angle A3 between the rear edge margin 360 and the central portion 350 of the cover is about 120 degrees, but this angle may vary.

Figure 11:
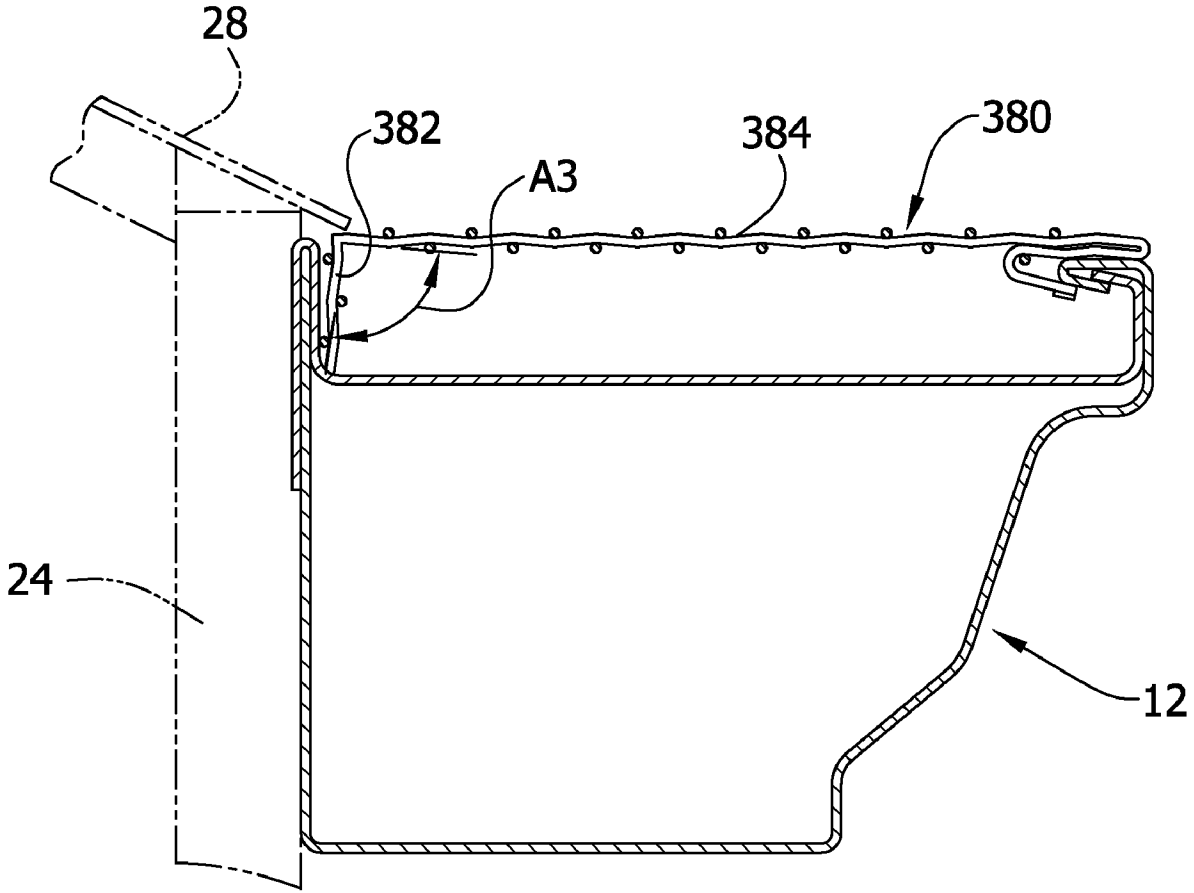
FIG. 11 is a view similar to FIG. 10 but showing a fourth embodiment of the gutter cover.

FIG. 11 illustrates an alternative embodiment of the gutter cover 380 substantially similar to the previous embodiment except the cover has an angle A3 between the rear edge margin 382 and the central portion 384 of the cover of about 90 degrees. The rear edge margin 382 of the cover 380 is angled generally parallel to the back wall 16 of the gutter 12 so that the space between the roof 28 and the top of the cover is reduced to decrease the possibility of leaves or other debris becoming caught between the cover and the roof.

Figure 12:
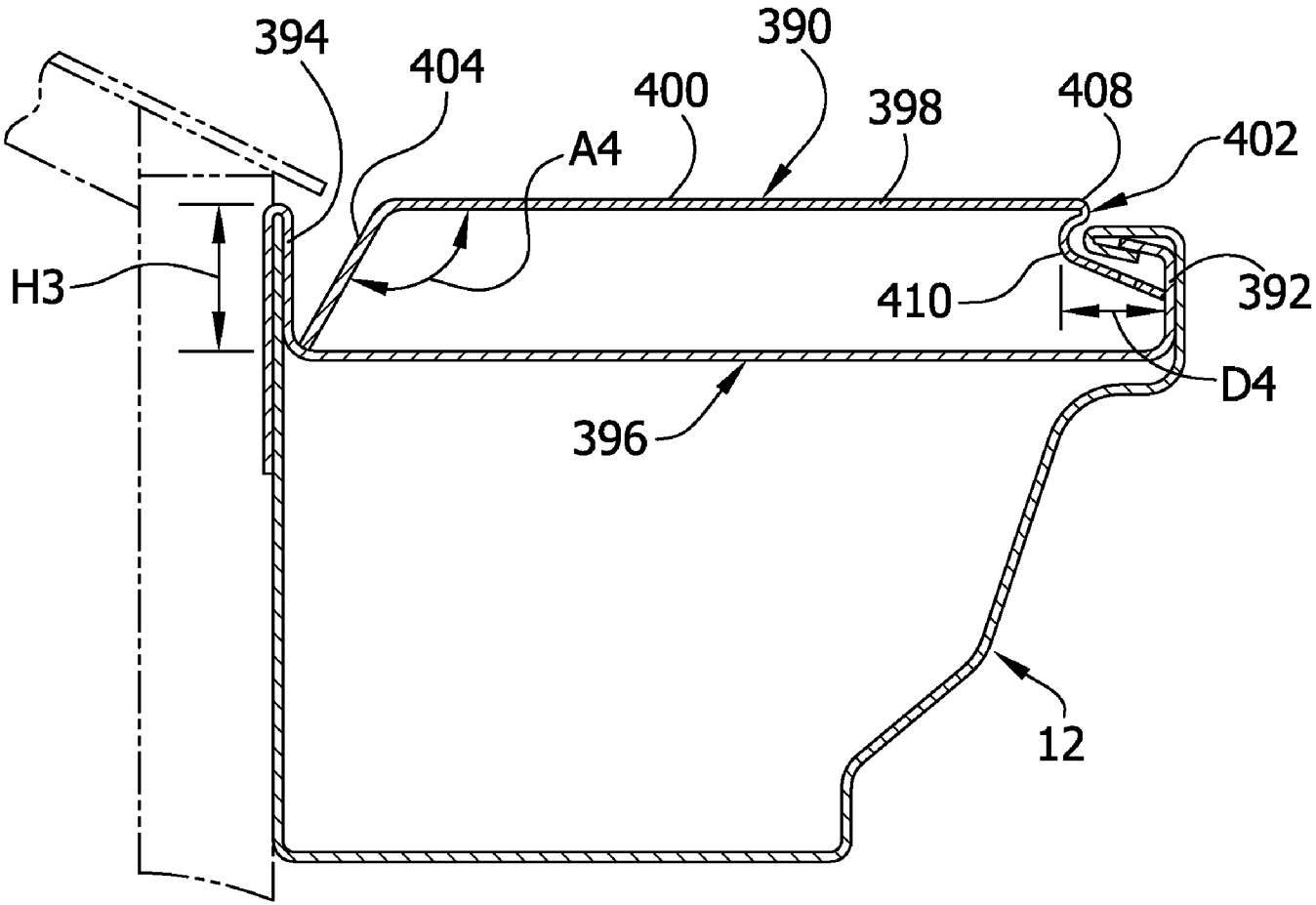
FIG. 12 is a transverse cross-sectional view of a fifth embodiment of the gutter cover installed on the gutter.
Figure 13:
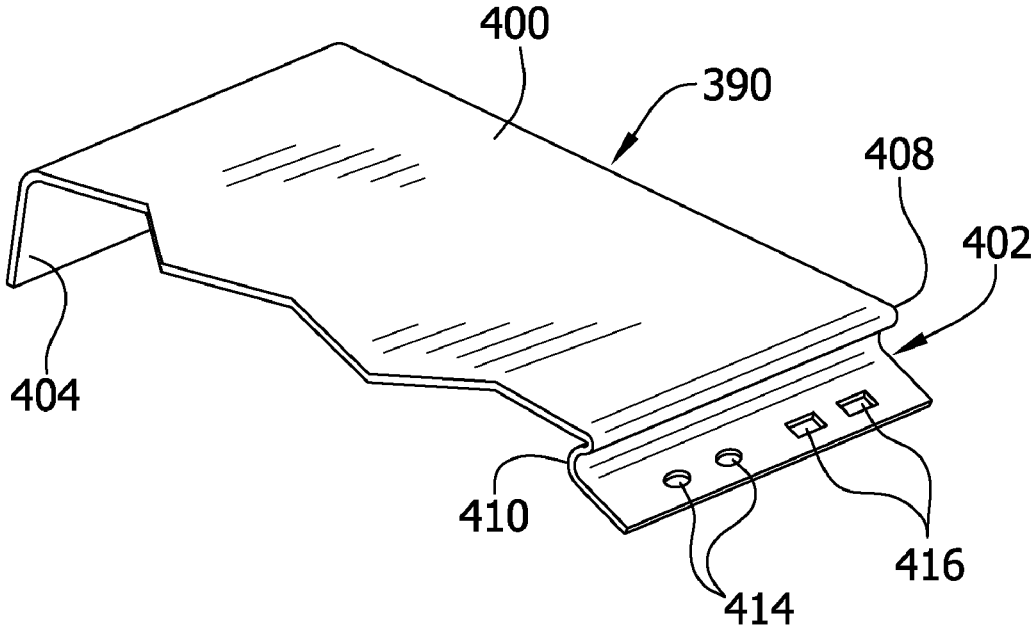
FIG. 13 is a fragmented perspective of the gutter cover of FIG. 12 removed from the gutter.

FIGS. 12 and 13 illustrate an alternative embodiment of the gutter cover 390 that is held in place between the front portion 392 and back portion 394 of the gutter hanger 396. The gutter cover 390 of this embodiment comprises a substantially continuous (non-perforated) sheet 398 having a generally flat central portion 400, a front portion 402 formed integrally with the central portion and bent downwardly to contact the front portion 392 of the gutter hanger 396, and a rear edge margin 404 formed integrally with the central portion and bent downwardly to contact the rear portion 394 of the gutter hanger. The gutter cover 390 is held in place above the channel of the gutter 12 by the contact of the front portion 402 of the cover with the front portion 392 of the gutter hanger 396 and the contact of the rear edge margin 404 of the cover with the rear portion 394 of the gutter hanger. In the embodiment of FIGS. 12 and 13, the cover 390 has an angle A4 between the rear edge margin 404 and the central portion 400 of the cover of about 120 degrees. The rear edge margin 404 contacts the bend 404 in the gutter hanger 396 so that the cover 390 is held in secure engagement in the gutter 12.

The front portion 402 of the gutter cover 390 comprises a top bend 408 and a lower bend 410 having a larger radius than the top bend so as to create a generally V-shaped channel for receiving the inner surface of the gutter flange 22. As shown in FIG. 13, the front edge margin of the gutter cover 390 has spaced apart openings 414, 416 located along the longitudinal length of the cover for the flow of water through the cover and into the gutter 12. In the illustrated embodiment, the openings 414 are circular and the openings 416 are rectangular shape but the openings may be other shapes and sizes (e.g., elongate slots) without departing from the scope of this invention. The discrete openings 414, 416 may be replaced by a single elongate opening without departing from the scope of this invention.

In one embodiment, the cover 390 has a height H3 above the gutter hanger 396 ranging from about inch to 1½ inch, in one embodiment about 1⅛ inch. The V-shaped channel of the front portion 402 of the cover 390 may have a depth D4 ranging from about inch to 1¼ inch, in one embodiment about ¾ inch. The radius of curvature of the lower bend 410 may range from about ¼ inch to ⅝ inch, in one embodiment more preferably about ⅜ inch. The circular openings 414 may have a diameter ranging from about ⅛ inch to ¾ inch, in one embodiment about ⅜ inch, and the rectangular openings 416 may have a length and width ranging from about ⅛ inch to 1¼ inch, in one embodiment about ¼ inch by inch. The cover may be made of suitable materials (e.g., metal, vinyl, plastics, etc.) and have a thickness no greater than about 0.1 inches.

Figure 14:
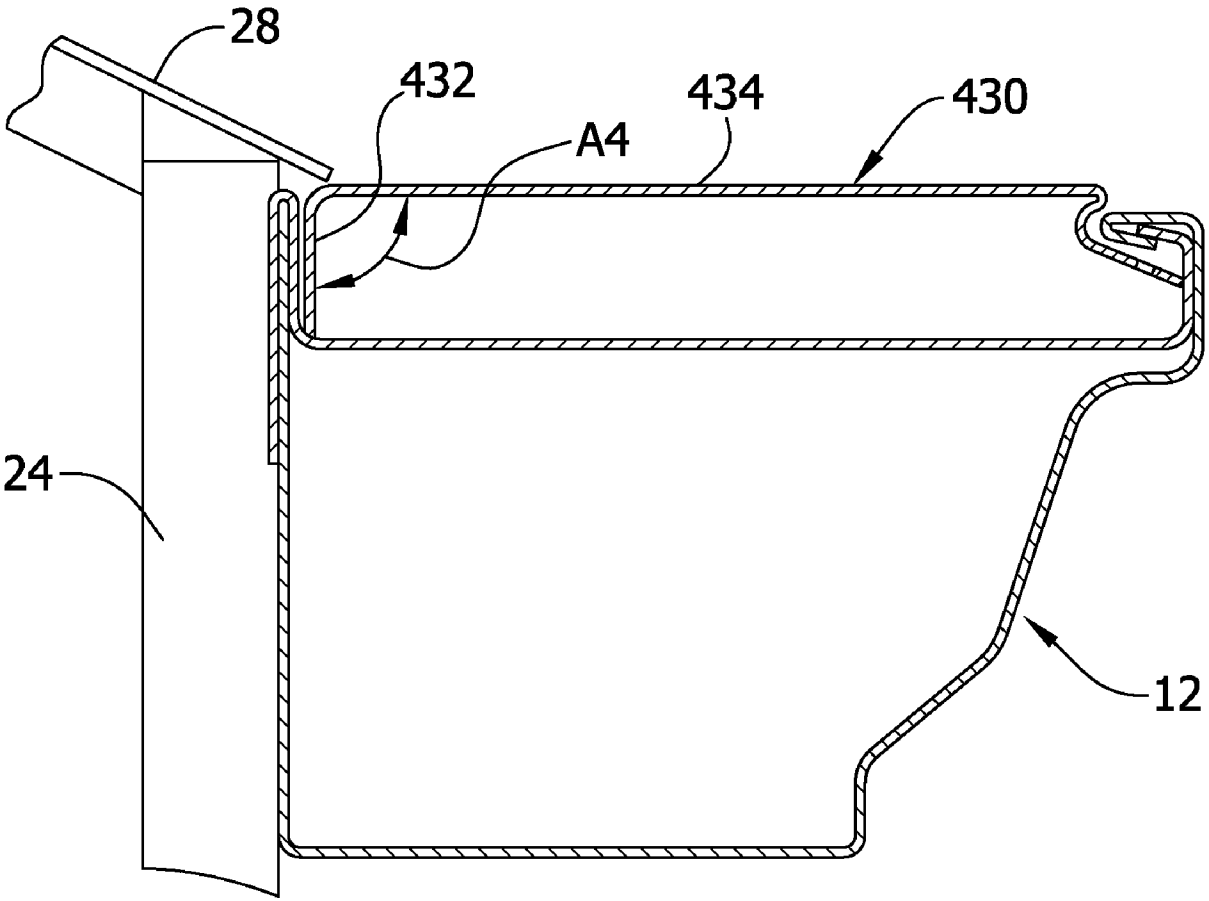
FIG. 14 is a view similar to FIG. 12 but showing a sixth embodiment of the gutter cover.

FIG. 14 illustrates an alternative embodiment of the gutter cover 430 substantially similar to the previous embodiment except the cover has an angle A4 between the rear edge margin 432 and the central portion 434 of the cover of about 90 degrees. The rear edge margin 432 of the cover 430 is generally parallel to the back wall 16 of the gutter 12 so that the space between the roof 28 and the top of the cover is reduced to decrease the possibility of leaves or other debris becoming caught between the cover and the roof.

Figure 15:
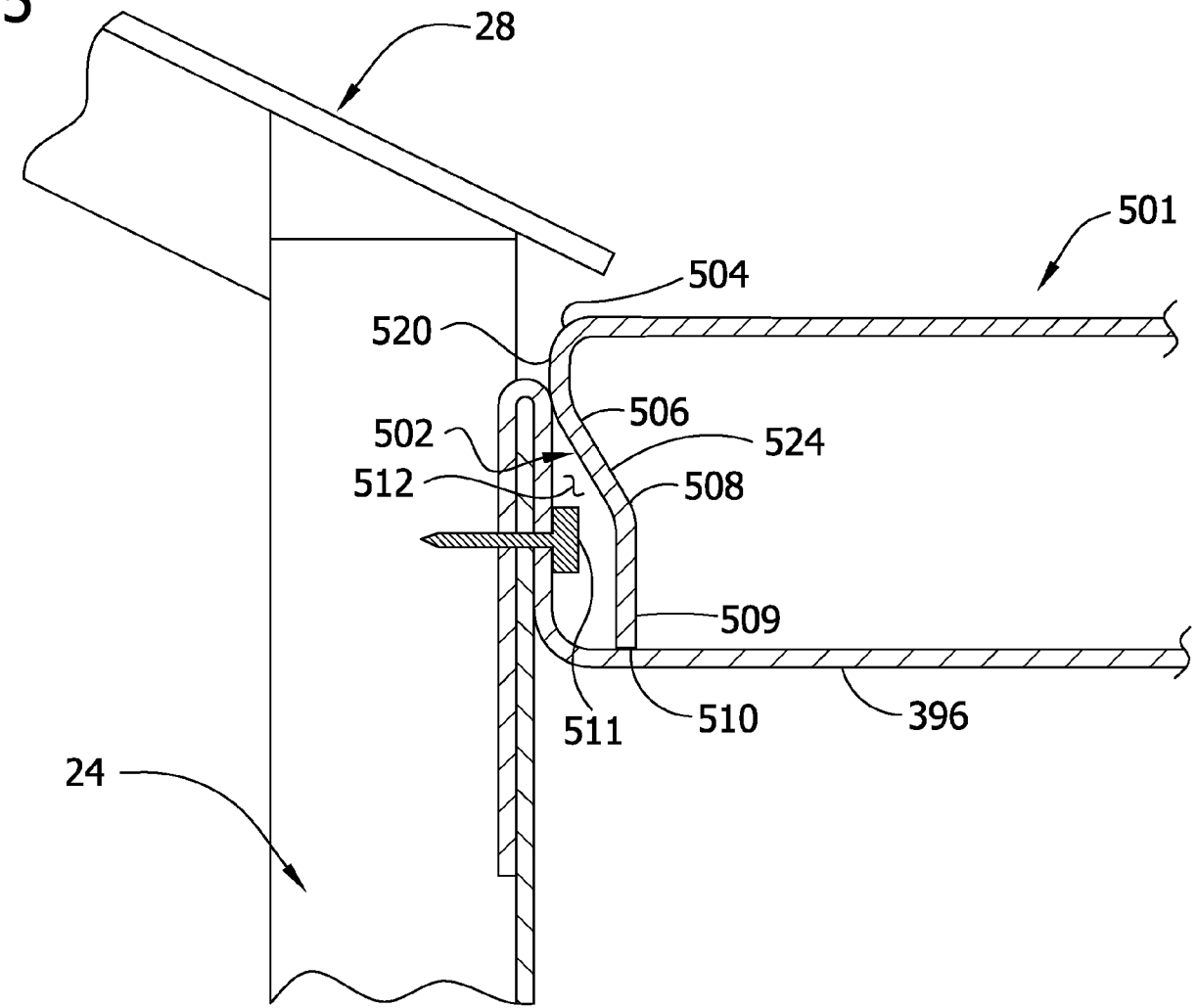
FIG. 15 is an enlarged transverse cross-sectional view of a rear bend of a seventh embodiment of the gutter cover.

FIG. 15 shows another gutter cover 501 (broadly, a gutter protection system). Generally, the rear section of cover 501 includes 3 bends and a straight portion. The rear section 502 of this cover 501 includes an upper (first) bend 504 (a downward bend), an intermediate (second) bend 506 (inward), a first upper portion 520 extending generally vertically downward from the upper bend to the intermediate bend, a lower (third) bend 508 (downward), and a second intermediate portion 524 angling downward and forward from the upper portion 520. The rear section is thus formed so that it does contact (or "clears") the head 511 of a gutter hanger fastener (e.g., a nail or screw). The angles of the bends 504, 506 and 508, and the distance between the bends, are chosen to ensure that the cover does not contact the fastener head 511.

Below the lower bend 508, there is a third generally straight bottom portion 509, and an end 510 of the bottom portion rests on the hanger 396. The bottom portion 509 is generally perpendicular to the hanger 396, i.e., generally vertical as shown in FIG. 15, such that portions 524 and 509 form a recess 512 for the fastener head 511. This generally straight portion 509 increases the strength of the cover 501 so that its load capacity is greater than that of prior art rear sections of like material. This generally straight portion helps the cover to withstand a heavy load, such as a snow load. This cover may also be cheaper than prior art covers because a thinner gage material may be used while maintaining sufficient strength and load capacity in the cover.

Figure 16:
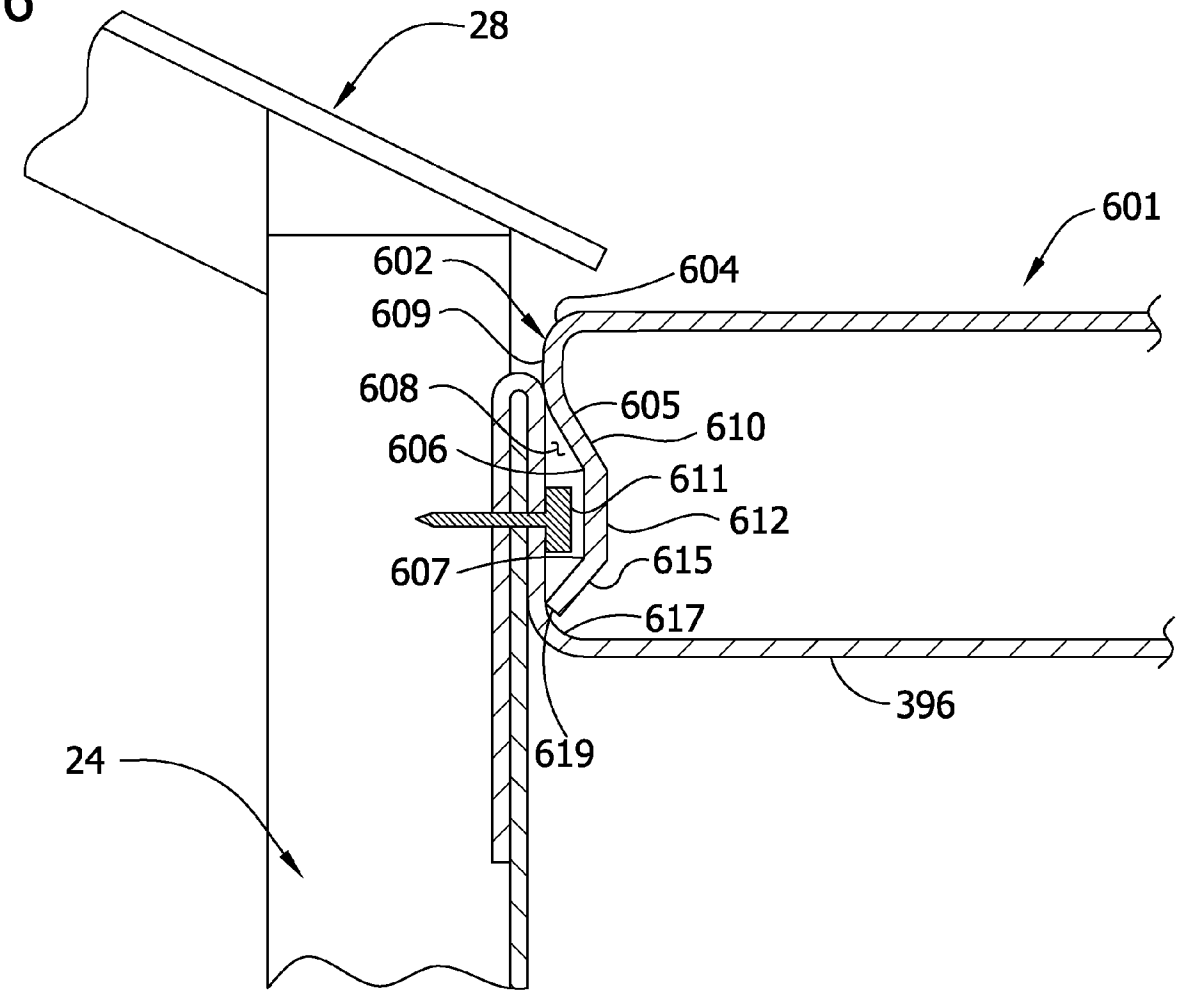
FIG. 16 is a view similar to FIG. 15 but showing a rear bend of an eighth embodiment.

FIG. 16 shows a gutter cover 601 including a rear section 602 having a recess 608 for receiving the head 611 of a fastener. The rear section 601 includes an upper (first) bend 604, an inward (second) bend 605, and two (third and fourth) outward bends 606 and 607. The bends together form the recess 608 for receiving the fastener head 611. As shown in FIG. 16, the bends 604, 605, 606, 607 are connected by a first upper portion 609 extending generally vertically downward from the first bend to the second bend, a second intermediate portion 610 angling downward and forward from the second bend 605 to the third bend 606, a third intermediate portion 612 extending generally vertically downward from the third bend 606 to the fourth bend 607, and a fourth bottom portion or leg 615 angling downward and rearward from the fourth bend 607. The recess 608 is formed by portions 610, 612, and 615 connected by bends 606 and 607. Bottom leg 615 is generally received in a space between the head 611 and a corner 617 of the hanger 396. The bottom leg 615 of the rear section includes an end 619 that is in generally vertical alignment with the upper bend 604 and received in the corner 617 of the gutter hanger 396. The bottom leg 615 of the cover 601 is thereby inhibited from lifting up or moving out of position by the fastener head 611.

As described in U.S. Pat. No. 5,893,240, a gutter cover may be held in place in the gutter by stressing the cover. The FIG. 15 embodiment is designed for an unstressed cover, but could also be used in a stressed configuration. In contrast, the FIG. 16 embodiment is designed for a stressed cover, but could also be used in an unstressed cover. Note that the front margin of the covers 501, 601 may be formed in any of the ways described above, or in other ways known in the art, for installation of the cover in the gutter. For example the front margin may be like FIG. 3, 6-7, 10-12 or 14.

The embodiments of FIGS. 15 and 16 ensure that the rear section of the gutter cover is close to the fascia board, but also ensures that the rear section clears the gutter hanger attachment nail or screw head. These designs close the gap between the gutter cover and the fascia board and increase the strength of the cover. The gutter cover is shown as a solid metal cover, but may also be made of perforated metal or of screen, among others. The terms gutter protection system and cover include protection devices made of perforated metal, screen and/or other materials.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense. Further, all dimensional information set forth herein is exemplary only and is not intended to limit the scope of the invention. It is understood that any of the particular embodiments of the present invention may include one or more of the aspects or features of the invention as described herein and illustrated in the drawings.

What is claimed is:

1. A gutter protection system for covering a gutter of a structure and for preventing debris from falling into the gutter, the gutter including a gutter hanger extending from a front flange of the gutter to a rear of the gutter and having a rear bend and a fastener securing the hanger and gutter to the structure at the rear of the gutter, the gutter protection system comprising an elongate member sized and shaped to engage the gutter hanger, the elongate member including, as viewed in cross-section when the elongate member is installed, a rear section having a first forwardly-opening bend, a second forwardly-opening bend spaced downward from the first bend, an upper straight portion extending generally vertically downward from the first bend to the second bend, a third rearwardly-opening bend spaced downward from the second bend, an intermediate portion angling downward and forward from the second bend to the third bend to provide clearance for said fastener, and a third straight portion extending generally vertically downward from the third bend toward the hanger at a location forward of the fastener to form a recess receiving the fastener.

2. A gutter and gutter protection system for covering the gutter and for preventing debris from falling into the gutter, the gutter including a gutter hanger having a front portion engaging a front of the gutter, a center portion extending over a channel of the gutter, and a rear portion bent upward from the center portion and engaging a rear of the gutter, the gutter also including a fastener through the rear portion of the hanger for securing the hanger and gutter, the gutter protection system comprising an elongate member extending over the gutter channel and engaging the gutter hanger, the elongate member including, as viewed in cross-section when the elongate member is installed, a rear section having a first uppermost bend, a second inward bend spaced downward from the first bend, a third outward bend spaced downward from the second bend, a fourth outward bend spaced from the third bend, a first upper straight portion extending generally vertically downward from the first bend to the second bend, a second intermediate portion angling downward and forward from the second bend to the third bend, a third intermediate straight portion extending generally vertically downward from the third bend to the fourth bend, and a bottom portion angling downward and rearward from the fourth bend, the second, third, and bottom portions connected by the second, third and fourth bends forming a recess receiving the fastener.

3. The gutter and gutter protection system of claim 2 wherein the bottom portion terminates in an end engaging the bend at a juncture of the center and rear portions of the hanger to inhibit movement of the protection system relative to the gutter.

4. A gutter cover for covering a gutter and for preventing debris from falling into the gutter, the gutter including a gutter hanger extending from a front flange of the gutter to a rear of the gutter and having a rear bend and a fastener securing the hanger and gutter to the structure at the rear of the gutter, the gutter cover comprising an elongate member sized and shaped to engage the gutter hanger, the elongate member having a rear section that, as viewed in cross-section when the gutter is installed, comprises:

a first forwardly-opening bend;

a second forwardly-opening bend spaced downward from the first bend;

a first upper straight portion extending generally vertically downward from the first bend to the second bend;

a third rearwardly-opening bend spaced downward from the second bend;

a second intermediate portion angling downward and forward from the second bend to the third bend to provide clearance for said fastener; and a third straight portion extending generally vertically downward from the third bend to form a recess for receiving the fastener.

5. A gutter cover for covering a gutter and for preventing debris from falling into the gutter, the gutter including a gutter hanger extending from a front flange of the gutter to a rear of the gutter and having a rear bend and a fastener securing the hanger and gutter to the structure at the rear of the gutter, the gutter cover comprising an elongate member sized and shaped to engage the gutter hanger, the elongate member having a rear section that, as viewed in cross-section when the gutter is installed, comprises:

a first forwardly-opening bend;

a second forwardly-opening bend spaced downward from the first bend;

a first upper straight portion extending generally vertically downward from the first bend to the second bend;

a third rearwardly-opening bend spaced downward from the second bend;

a second intermediate portion angling downward and forward from the second bend to the third bend to provide clearance for said fastener;

a fourth rearwardly-opening bend spaced downward from the third bend, a third intermediate straight portion extending generally vertically downward from the third bend to the fourth bend, and a fourth bottom portion angling downward and rearward from the third bend and terminating in an end adapted to engage the hanger, the second, third, and fourth portions of the rear section connected by the second, third and fourth bends of the rear section forming a recess for receiving the fastener.

6. The gutter cover of claim 5 wherein the end of the fourth bottom portion is in generally vertical alignment with the first forwardly-opening bend.

7. The gutter cover of claim 1 wherein said first and third straight generally vertical portions have a combined height about half of an overall height of said rear section of the elongate member.

8. The gutter cover of claim 2 wherein said first and third straight generally vertical portions have a combined height about half of an overall height of said rear section of the elongate member.

9. The gutter cover of claim 4 wherein said first and third straight generally vertical portions have a combined height about half of an overall height of said rear section of the elongate member.

10. The gutter cover of claim 5 wherein said first and third straight generally vertical portions have a combined height about half of an overall height of said rear section of the elongate member.

11. The gutter cover of claim 2 wherein said third straight generally vertical portion has a height greater than the diameter of a head of the fastener.

* * * * *